United States Patent [19]

Sorensen

[11] 4,120,461

[45] Oct. 17, 1978

[54] LUMP BREAKING DEVICE

[76] Inventor: Heine Ahlgreen Sorensen, R.R. #3, Ayers Cliff, Quebec, Canada, J0B 1C0

[21] Appl. No.: 786,582

[22] Filed: Apr. 11, 1977

[51] Int. Cl.[2] ..... B02C 1/00

[52] U.S. Cl. ..... 241/283; 144/162 R; 241/263

[58] Field of Search ..... 241/262, 263, 270, 283; 144/162 R

[56] References Cited

U.S. PATENT DOCUMENTS

| | | | |
|---|---|---|---|
| 81,303 | 8/1868 | Siemers | 241/283 X |
| 170,560 | 11/1875 | Heston | 241/283 X |
| 773,673 | 11/1904 | Perkins | 241/283 |
| 3,375,984 | 4/1968 | Robbins | 241/262 X |

FOREIGN PATENT DOCUMENTS

| | | | |
|---|---|---|---|
| 1,086,524 | 8/1960 | Fed. Rep. of Germany | 241/263 |
| 2,126,284 | 12/1972 | Fed. Rep. of Germany | 241/283 |

*Primary Examiner*—Howard N. Goldberg
*Attorney, Agent, or Firm*—Charles E. Brown

[57] ABSTRACT

A lump breaking device for breaking lumps formed in particulate material. The device comprises a plurality of parallel spaced elongated support members and a plurality of saw-tooth elements supported by a portion of the elongated support members. The saw-tooth elements have opposed lump-breaking edges extending on at least one side of the support members in a plane extending parallel to the longitudinal axis of said support members. A reciprocating drive is secured to the support members for reciprocating them along the longitudinal axis whereby the lump-breaking edges will reciprocate and break up lumps of particulate material positioned thereover.

1 Claim, 6 Drawing Figures

LUMP BREAKING DEVICE

BACKGROUND OF INVENTION (a) Field of the Invention

The present invention relates to a lump breaking device for breaking lumps formed in particulate material and wherein saw-tooth elements are reciprocated to break lumps of particulate material to smaller size.

(b) Description of Prior Art

Lump breaking devices are normally installed in the bottom of storage bins containing particulate material to provide for the discharge end flow of material through an outlet end of the storage bins. An example of particulate material stored in bins is wood chips. A serious problem exists in that wood chips are shipped to mills by trucks and railroad cars and in the winter months, often the chips freeze up when they arrive at the mill and after being unloaded and transferred to the storage bin, they are large chunks of particulate material contained therein which clog up the outlet end of the bins. This problem also occurs when storing particulate material outdoors and exposed to weather.

SUMMARY OF INVENTION

It is a feature of the present invention to provide an improved lump breaking device which substantially overcomes the above-mentioned disadvantages and which has many applications.

According to the above feature, from a broad aspect, the present invention provides a lump breaking device for breaking lumps formed in particulate material. The device comprises a displaceable support means and a plurality of saw-tooth elements supported by a portion of the support means. Each of the saw-tooth elements have opposed lump-breaking edges extending on at least one side of the support means and disposed in a plane extending parallel to one another and parallel to a reciprocating axis. A reciprocating drive is secured to the support means for reciprocating them along the reciprocating axis whereby the lump-breaking edges will reciprocate and break up lumps of particulate material positioned thereover.

BRIEF DESCRIPTION OF DRAWINGS

A preferred embodiment of the present invention will now be described with reference to illustrations of the preferred embodiment as shown in the enclosed drawings in which.

DESCRIPTION OF PREFERRED EMBODIMENTS

Figure 1:
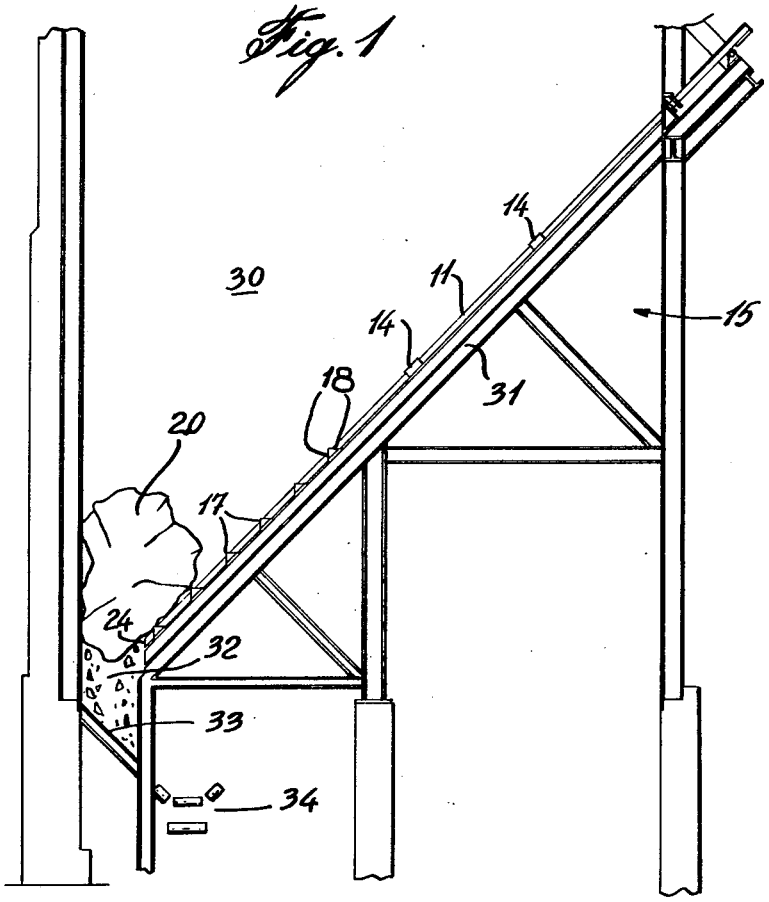
FIG. 1 is a side view of a lump breaking device of the present invention.
Figure 2:
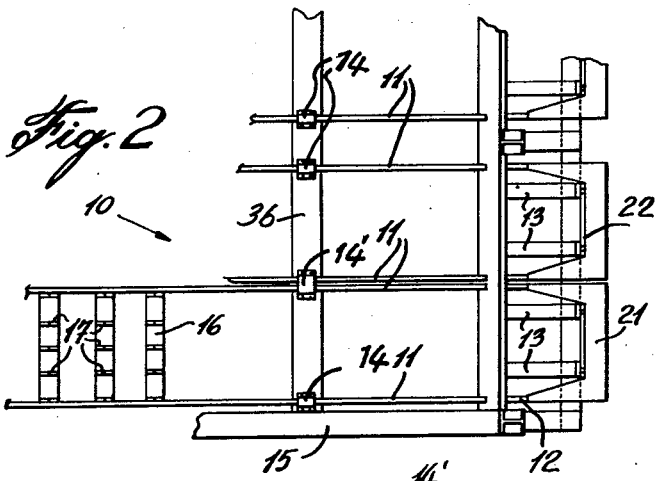
FIG. 2 is a fragmented top view of a portion of FIG. 1.

Referring now to the drawings, and more particularly to FIGS. 1 and 2, there is shown generally at 10 the lump breaking device of the present invention. The lump breaking device comprises support means, herein a plurality of parallel spaced elongated support members 11 having a free end 12 secured to a reciprocating drive, herein pistons 13, whereby the members 11 are reciprocated axially. The elongated support members 11 extend through guide bearings 14 which are secured to a framework of a mounting frame 15 in a well-known manner whereby to guide the elongated support members 11 for axial reciprocation. As shown in FIG. 1, a plurality of guide bearings 14 may be secured to the frame 15 along the length of the members 11.

At least one bridge bar 16, a plurality being shown in FIG. 2, is secured between pairs of support members 11 remote from their free ends. These bars 16 may be secured by welding or other means. A plurality of flat saw-tooth elements 17 of substantially triangular shape are secured, such as by welding, in spaced-apart parallel relationship to each bridge bar 16. The saw-tooth elements have opposed lump breaking edges 18 which extend on at least one side of the bridge bars 16, herein the top side, and extend in a plane parallel to the longitudinal axis of the support members. The lump breaking edges 18 are opposed cutting edges extending angularly from the apex 19 of each saw-tooth element 17.

It can be seen that by reciprocating the elongated support members 11 by means of a piston 13, or other suitable means, that the saw-tooth elements 17 will also be caused to reciprocate and saw off or break lumps of particulate material positioned thereover. Such a lump of particulate material is denoted by numeral 20 in FIG. 1.

As shown in FIG. 2, the elongated support members 11 are secured at their upper free end 12 to a reciprocable connecting frame 21. The piston rods 22 of the pistons 13 are secured to the connecting frame 21. By actuating the pistons 13, the connecting frame 21 will be caused to move to its remote position as indicated by phantom lines 23. This will cause a pair of elongated support members 11 to move upwardly towards the piston 13. As shown in FIG. 2, a plurality of pairs of support members 11 are positioned adjacent to each other and the pistons 13 may be caused to reciprocate in an alternating sequence to saw-off a lump of particulate material. Alternatively, the pistons 13 of each pair of support members 11 can reciprocate in sequence as it may not be necessary to support any lump of particulate material over the saw-tooth elements 17 that can pass through an opening such as 32. The lower end 24 of each support member is a sharp pointed end to penetrate and break up the lower portions of the lumps 20 positioned adjacent the discharge end 32 of a silo.

As shown in FIG. 1, the support members 11 are secured in a silo 30 on an angular base 31 supported by the frame 15, with the saw-tooth elements 17 being reciprocable adjacent the lower end of the base 15 adjacent the discharge end 32. As the saw-tooth elements 17 are reciprocated, they will break up the lump 20 of particulate material and cause the broken particulate material to fall into the discharge end 32 and onto a slide 33 where the particulate material is then directed to a conveyor 34 to convey the material to a mill or another location where it is required. Although not shown, a bottom wall is supported by the angular base 31 to retain the particulate material within the silo 30.

Figure 3:
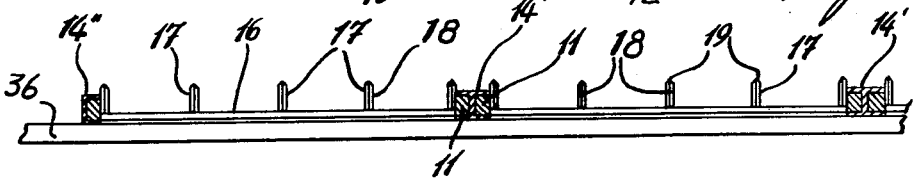
FIG. 3 is an end view showing the saw-tooth elements.
Figure 4:
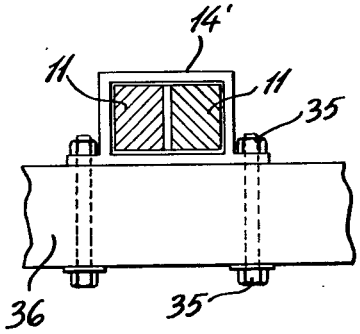
FIG. 4 is a cross-section view of a double guide bearing for the support members.

Referring now to FIGS. 3 and 4, there is shown a section view of the elongated support members 11 secured in a double guide bearing 14' and a single guide bearing 14''. The construction of the double guide bearing is illustrated in FIG. 4 and consists essentially of a rectangular sleeve permitting movement of the elongated support members 11 of adjacent pairs of members. The rectangular housing is secured by bolts 35 to support members 36 on the base 31 of the mounting frame 15.

Figure 6:
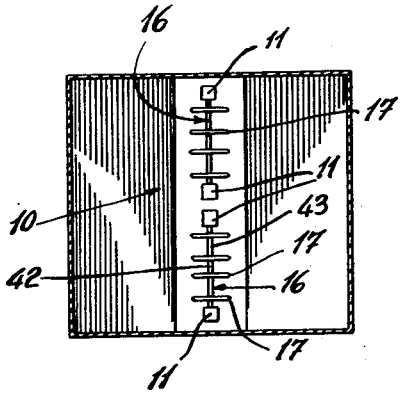
FIG. 6 is a section view of FIG. 5 showing the position of the lump breaking device.
Figure 5:
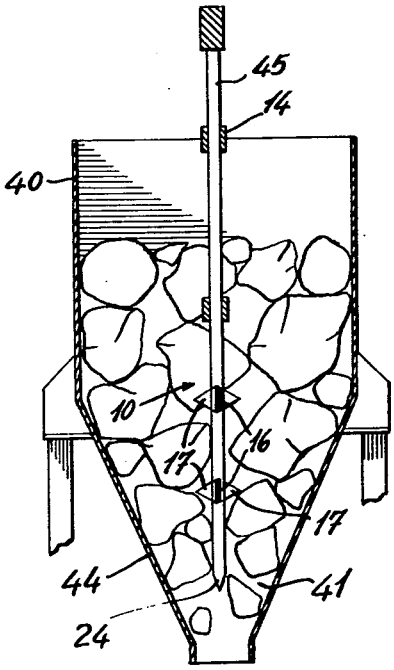
FIG. 5 is a schematic illustration of a further embodiment of a lump breaking device of the present invention.

Referring now to FIGS. 5 and 6, there is shown another application of the lump breaking device 10. As herein shown, the elements 11 are positioned vertically in a silo 40 and guided for vertical reciprocation. Also, as shown, the saw-tooth elements extend from opposed surfaces 42 and 43 of the bridge bars 16. The discharge end 41 is usually conical and any lump located in the discharge end between the conical wall 44 and the lower end of the support members 11 will be broken up by the vertical reciprocation of the support members and saw-tooth elements 17. As in the previous embodiment, a piston 45 is located at the upper free end of the members 11 to impart reciprocation thereto in the same manner as previously described.

Although only two examples of the preferred embodiment are illustrated herein, it is obvious to one skilled in the art that the lump breaking device of the present invention can be adapted to many types of storage bins or even to a free-standing storage pile of particulate material whereby to break lumps being discharged for transportation. For example, the reciprocating members 11 and saw-tooth elements 17 may be positioned adjacent a pit in which a conveyor is located and the particulate material can be directed onto this pit by other conveying means or pushing means, such as a tractor or pusher bars. It is, therefore, intended to cover any obvious modiciations of the present invention provided these modifications fall within the broad scope of the invention as defined by the appended claims.

I claim:

1. A lump breaking device for breaking lumps formed in particulate material, said device comprising displaceable support means, a plurality of saw-tooth elements supported by a portion of said support means, each said saw-tooth elements having opposed lump-breaking edges extending on at least one side of said support means and disposed in a plane extending parallel to one another and parallel to a reciprocating axis, reciprocating drive means secured to said support means for reciprocating same along said reciprocating axis whereby said lump-breaking edges will reciprocate and break up lumps of particulate material positioned thereover, said displaceable support means comprising a plurality of parallel spaced elongated support members extending parallel to said reciprocating axis, said lump-breaking edges being opposed cutting edges, said opposed cutting edges extending angularly from an apex of each said saw-tooth elements, said reciprocating drive means being at least one piston secured adjacent a free end of one or more of said support members, a plurality of bridge bars secured between pairs of said support members remote from said free end, said saw-tooth elements being secured to said bridge bars, said bridge bars being disposed parallel to one another and secured at opposite ends between respective pairs of said support members, and guide bearings for maintaining said support members in parallel relationship and in a respective longitudinal axis, adjacent pairs of said pairs of support members being reciprocated in alternating sequence, and said support members being pointed at their ends opposed to said free ends to penetrate and break up lumps of particulate material.

* * * * *